United States Patent [19]

Wakimura

[11] 4,224,761

[45] Sep. 30, 1980

[54] TOY FISHING PLAY UNIT

[76] Inventor: Kazuo Wakimura, No. 2-11-20, Nishiarai, Adachi-ku, Tokyo, Japan

[21] Appl. No.: 33,321

[22] Filed: Apr. 25, 1979

[30] Foreign Application Priority Data

Oct. 21, 1978 [JP] Japan ..... 53-144911

[51] Int. Cl.[3] ..... A63B 6/06

[52] U.S. Cl. ..... 46/123; 46/135 R; 273/330

[58] Field of Search ..... 46/123, 135 R, 145, 46/116, 119; 273/101, 85 A, 1 R, 1 E, 1 M

[56] References Cited

U.S. PATENT DOCUMENTS

| | | | |
|---|---|---|---|
| 4,109,914 | 8/1978 | Matsumoto | 273/101 |
| 4,149,725 | 4/1979 | Todokoro | 46/123 |
| 4,177,992 | 12/1979 | Todokoro | 46/145 |

*Primary Examiner*—Robert A. Hafer

[57] ABSTRACT

A toy fishing-play unit generally includes a base plate which is provided with a plurality of upwardly protruded ridges, a turning disk turnably mounted on the base plate and provided with a plurality of cells, a plurality of fish models removably received in the cells, a driving unit for turning the turning disk and a toy fishing tackle. When the fish model rides on the ridge a mouth of the fish model is opened to receive a bait, and when the fish model gets off the ridge the mouth of the fish model is closed to bite the bait.

4 Claims, 5 Drawing Figures

TOY FISHING PLAY UNIT

BACKGROUND AND SUMMARY OF THE INVENTION

This invention relates to a toy fishing-play unit and more particularly to a toy fishing-play unit in which a fish model may be manually landed with a toy fishing tackle.

Hitherto, there have been proposed and enjoyed various kinds of toys for fishing-play with a fish model and a toy fishing tackle. In the conventional toy, however, the fish models have been immovably placed on a stationary or movable plate and unable to move their bodies, especially their mouths just like a living fish in leaping and snapping at the bait.

In order to increase an amusing effect of the toy according to the invention, a fish model moves up and down to open and close the mouth on account of the turning movement of the disk on which the fish model is placed removably. While the mouth of the fish model is opened a hook or a bait of the fishing tackle may be manually inserted thereinto and then the mouth is closed to bite the bait for subsequent landing operation.

It is, therefore, a general object of the invention to provide a toy fishing-play unit with which a fishing of like the living fish may be enjoyed.

According to the invention, there is provided a toy fishing-play unit comprising a base plate which is provided on its bottom surface with a plurality of discontinuous upstanding ridges which are arranged circumferentially and irregularly, a turning disk turnably mounted on the base plate and provided therein with a plurality of cells each having a slit for passing the ridge therethrough, a plurality of fish models adapted to be removably received in the cells and consisting of a body, a mouth swingably pivoted to the body and a base for supporting the body, a driving unit for turning the turning disk, and a toy fishing tackle including a rod with a string and a bait suspended at a free end of the string for insertion into the opened mouth of the fish model.

According to the toy fishing-play unit of the invention, an engaging means in the form of teeth may be provided in the mouth of the fish model for ensuring the landing operation.

Further, the bait member of the fishing tackle may be of a spherical shape which is convenient for receipt by the opened mouth so that more amusing fishing-play may be enjoyed by a player.

Furthermore, the fish model may be carried on a base member for stabilization not only in a received position in the cell but also in a set position on another place.

BRIEF DESCRIPTION OF THE DRAWINGS

Other objects and advantages of the invention will be apparent from the following disclosure taken in conjunction with the accompanying drawings, in which.

BEST MODE FOR CARRING THE INVENTION

Figure 1:
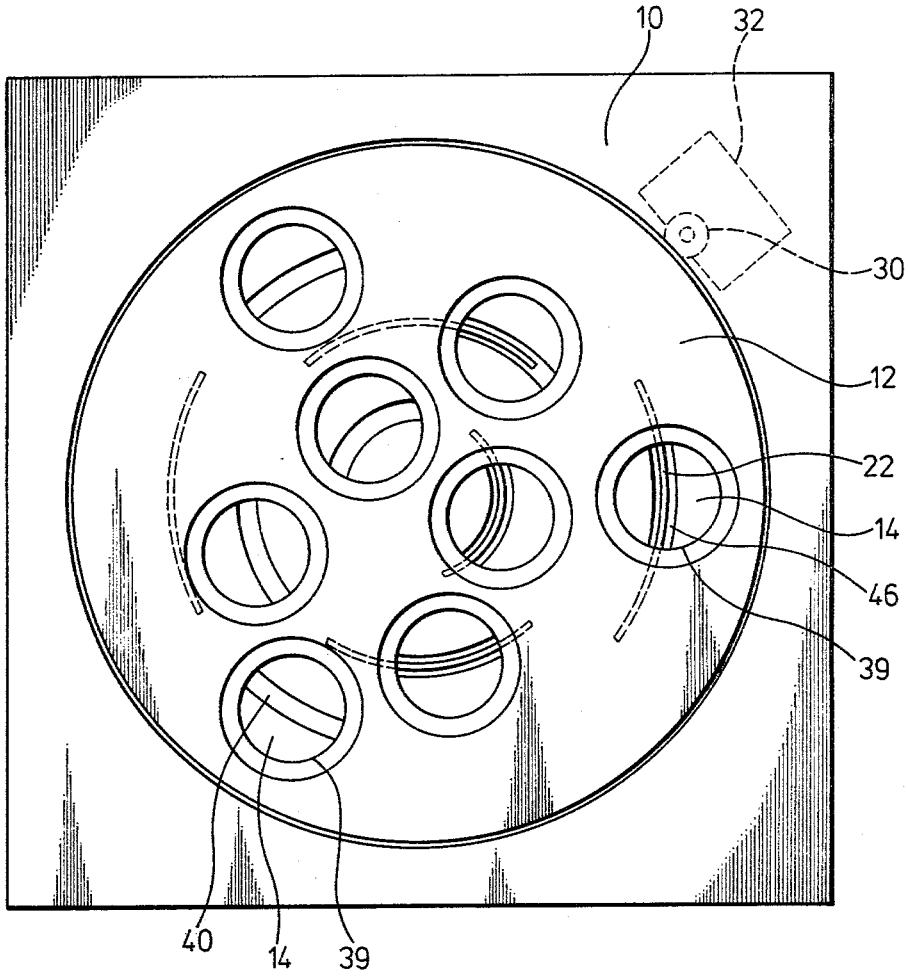
FIG. 1 is a plan view of the toy fishing-play unit with the turning disk according to the invention.
Figure 2:
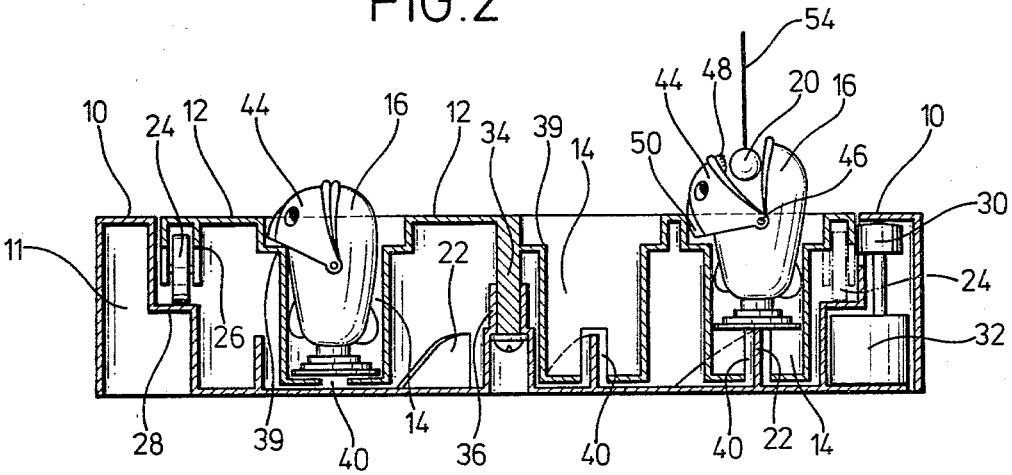
FIG. 2 is a cross sectional view of the unit with the fish model received in the cells provided in the turning disk.

Referring now to the drawing, wherein like reference character refer to like parts, a toy fishing-play unit according to the invention is shown in FIGS. 1 and 2 and the unit basically includes a base plate 10 with a stepped circumferential wall 11 and a turning disk 12 with cells 14, a fish model 16 removably received in the cell 14 and a fishing tackle 18 with a catching member or bait 20. The turning disk 12 is turnably mounted on the base plate 10 through bearing wheels 24, 24 placed between a flanged rim 26 of the disk 12 and a stepped track 28 of the base plate 10, and is turned by means of a friction wheel 30 connected to a motor 32 around a central axis 34 of the disk 12 which is turnably held by a central sleeve projection 36 of the base plate 10. On the bottom surface of the base plate 10 there are provided a plurality of discontinuous upstanding ridges 22 which are arranged circumferentially and irregularly around a center of the turning disk 12. In the disk 12 are provided a plurality of cells 14 with a shoulder 39 for receiving fish models 16 as hereinafter described. Each cell 14 at its bottom is provided with a guide slit 40 through which the ridge 22 is passed when the disk 12 is turned.

Figure 3:
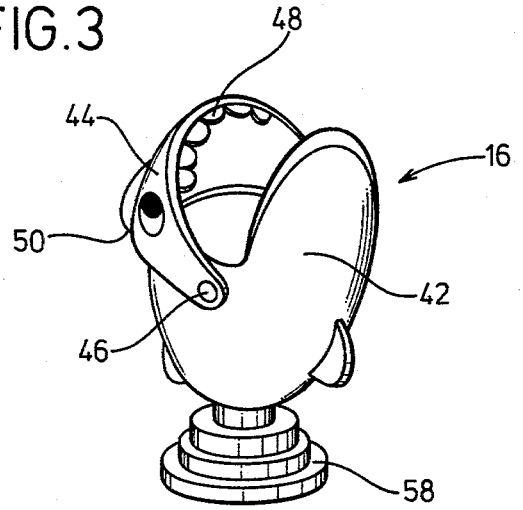
FIG. 3 is a perspective view of the fish model.

The fish model 16 to be played for landing is comprised of a body 42 to which a mouth member 44 is swingably pivoted through a pivot 46, as best shown in FIG. 3. The mouth member 44 is normally opened by its own gravity or by means of a convenient spring (not shown ). The mouth member 44 is selectively provided with an engaging member 48 in the form of teeth as an example. An outer remote periphery of the mouth member 44 is provided with a protuberance 50 adapted to rest on the shoulder 39 of the cell 14 to control an opening size of the mouth of the fish model 16 when raised or lowered by means of the ridge 22.

Figure 4:
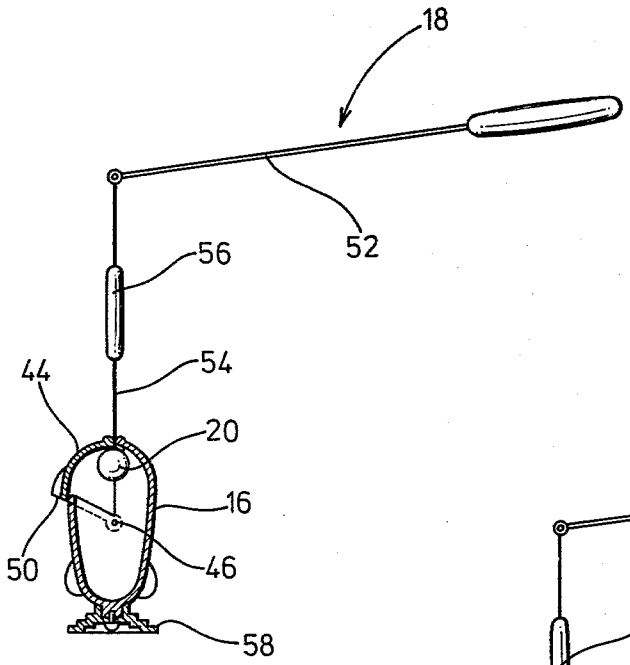
FIG. 4 is a lateral view of the fish model which is caught up by the fishing tackle.

In FIG. 4, to a rod 52 of the fishing tackle 18 is connected a string 54 which suspends at its free end a spherical catching member or a bait 20 through a convenient adjuster 56.

Figure 5:
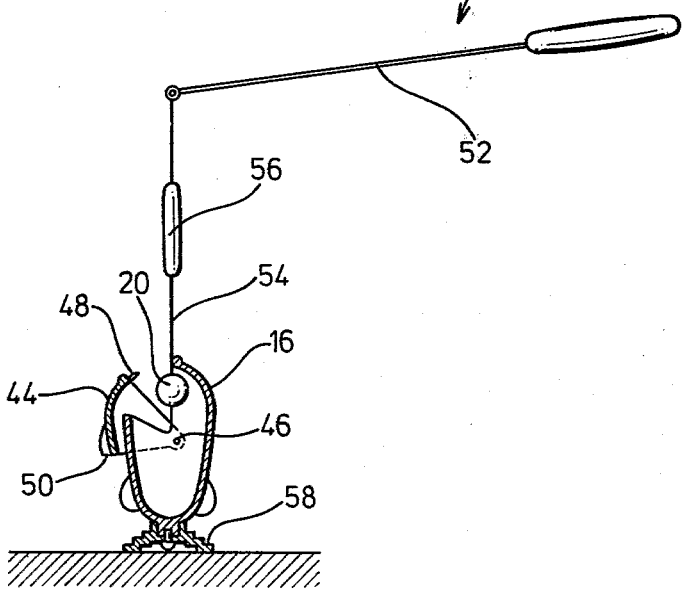
FIG. 5 is a lateral view similar to FIG. 4 but shows the fish model placed on another place with its mouth open.

The fish model 16 is preferably placed on a base member 58 of the size which fits the cell 14 for stabilization of the fish model 16 received in the cell 14. It will be appreciated that the base member 58 further stabilizes the fish model when placed on the ground or other places than the cell, as shown in FIG. 5.

In playing operation, the fish model 16 is placed in the cell 14 of the turning disk 12 and circulates on the base plate 10 when the disk 12 is forced to turn around the central axis 34. When the fish model 16 passes across the ridge 22, the mouth of the model is opened as shown in FIG. 2 leaving the protuberance 50 of the mouth member 44 in contact with the shoulder 39 of the cell 14. While the mouth is opened, the bait 20 of the fishing tackle 18 is quickly inserted into the mouth of the fish model 16 by the skilled operation of the player and when the fish model 16 moves out of the ridge 22 the mouth is closed to bite the catching bait 20. Thus, the fish model 16 may be landed by manually raising the fishing tackle 18.

As hereinbefore described, in accordance with the invention, the fish model moves up and down to open and close the mouth like a living fish depending on the shape and number of the ridge with increased amusement in the fishing play. Namely, if arrangements, number and shapes of the ridges are varied, the movement of the fish model may become more irregular with much more increased amusement in play.

Without further elaboration, the foregoing will so fully illustrate the invention that others may, by applying the current or future knowledge, readily adapt the same for use under various conditions of service.

What is claimed is:

1. A toy fishing-play unit comprising a base plate which is provided on its bottom surface with a plurality of discontinuous upstanding ridges which are arranged circumferentially and irregularly, a turning disk turnably mounted on the base plate and provided therein with a plurality of cells each having a slit for passing the ridge therethrough, a plurality of fish models adapted to be removably received in the cells and consisting of a body, a mouth member swingably pivoted to the body and a base for supporting the body, a driving unit for turning the turning disk, and a toy fishing tackle including a rod with a string and a bait suspended at a free end of the string for insertion into the opened mouth of the fish model.

2. A toy for fishing-play unit as claimed in claim 1, wherein the motor is connected through a friction wheel to the turning disk.

3. A toy for fishing-play unit as claimed in claim 1 or 2, wherein the mouth of the fish model is provided with an engaging member in the form of teeth.

4. A toy for fishing-play unit as claimed in any of claims 1 to 3, wherein the bait member of the fishing tackle is of a spherical shape corresponding to an opened mouth of the fish model.

* * * * *